US005202223A

United States Patent [19]

Shibata et al.

[11] Patent Number: 5,202,223

[45] Date of Patent: Apr. 13, 1993

[54] SILVER HALIDE LIGHT-SENSITIVE FILM MATERIAL SUBJECTED TO ANTISTATIC TREATMENT

[75] Inventors: Yoshio Shibata; Seiichi Sumi, both of Nagaokakyo; Akira Furukawa, Tsukuba, all of Japan

[73] Assignee: Mitsubishi Paper Mills Limited, Tokyo, Japan

[21] Appl. No.: 758,602

[22] Filed: Sep. 12, 1991

[30] Foreign Application Priority Data

| | | | |
|---|---|---|---|
| Sep. 14, 1990 | [JP] | Japan | 2-245654 |
| Sep. 14, 1990 | [JP] | Japan | 2-245655 |
| Sep. 14, 1990 | [JP] | Japan | 2-245656 |
| Sep. 14, 1990 | [JP] | Japan | 2-245657 |
| Sep. 14, 1990 | [JP] | Japan | 2-245658 |
| Sep. 14, 1990 | [JP] | Japan | 2-245660 |

[51] Int. Cl.[5] ..... G03C 1/76

[52] U.S. Cl. ..... 430/529; 430/523

[58] Field of Search ..... 430/523, 529, 526

[56] References Cited

U.S. PATENT DOCUMENTS 5,108,884 4/1992 Shibata et al. ..... 439/529

*Primary Examiner*—Jack P. Brammer

*Attorney, Agent, or Firm*—Cushman, Darby & Cushman

[57] ABSTRACT

The present invention provides a silver halide light-sensitive film material having a backcoat layer which is sufficiently subjected to antistatic treatment. This material has an electrically conductive polymer layer comprising a copolymer of N-methylol(meth)acrylamide and styrenesulfonic acid as an antistatic layer between a film base and the backcoat layer.

12 Claims, No Drawings

SILVER HALIDE LIGHT-SENSITIVE FILM MATERIAL SUBJECTED TO ANTISTATIC TREATMENT

BACKGROUND OF THE INVENTION

The present invention relates to a silver halide photographic light-sensitive material and more particularly, to a backcoat layer prevented from accumulation of static charges.

Films, papers and the like are used as a base for silver halide photographic materials and various problems have been brought about due to their low electrical conductivity.

One of the problems is that when a coating composition containing silver halide is coated on a film, a paper or the like, the composition is coated by a coater at a high speed and the base is electrically charged during being rubbed by roller, and upon being discharged, silver halide undergoes fogging (antistatic fogging). If electrical conductivity of backcoat layer is enhanced and thus, antistatic treatment is made, since usually the backcoat layer is coated before coating of silver halide emulsion, this backcoat layer also improves the antistatic properties of the opposite surface of the base on which the emulsion is coated, through the base, whereby antistatic fogging can be inhibited.

Another problem is that when users use light-sensitive materials, if the materials are electrically charged, dusts adhere to the light-sensitive materials and they often form undesired images such as pin holes during exposing and photographic treatments and besides, the light-sensitive materials stick to each other, resulting in deterioration of operability. Moreover, there is the problem that discharging occurs through hands of workers.

It is important that the materials must have good antistatic characteristics both before and after the treatments such as development, fixation and rinsing.

Japanese Patent Kokai Nos.56-92535 and 61 174542 disclose to provide an antistatic layer between a backcoat layer and a base to increase antistatic properties and besides, to use an aziridine hardener for improving adhesion between the antistatic layer and the backcoat layer. However, the aziridine hardener causes eruption of skin and is not desired for sanitary reasons. In addition, since the antistatic layer is provided between the base and the backcoat layer, adhesion of the backcoat layer is not sufficient and drying characteristics are inferior.

SUMMARY OF THE INVENTION

The object of the present invention is to provide a backcoat layer which has superior antistatic properties, inhibits blocking, has no influence on filter dyes contained therein, and is superior in adhesion and coatability.

That is, the present invention is a silver halide light-sensitive film material which has an electrically conductive polymer layer between a backcoat layer containing gelatin and a film base, wherein the electrically conductive polymer is a copolymer of N-methylol(meth)acrylamide and styrenesulfonic acid.

This silver halide light-sensitive film material of the present invention has further industrial merits in the following embodiments.

The first embodiment is that the electrically conductive polymer has a copolymerization ratio of N-methylol(meth)acrylamide of 10–60% by weight.

The second embodiment is that pH of the coating composition for the polymer layer is 1.5–3.0.

The third embodiment is that drying temperature for coating of the polymer layer is 40° C. or higher and the film is taken up in an atmosphere of 40–60% in relative humidity after completion of drying.

The fourth embodiment is that the electrically conductive polymer layer contains a specific surface active agent.

The fifth embodiment is that the electrically conductive polymer layer contains a matting agent.

DESCRIPTION OF THE INVENTION

The present invention will be explained in detail below.

The electrically conductive polymer used in the present invention is a copolymer of N-methylol(meth)acrylamide and styrenesulfonic acid, which is cross-linked upon heating. Proportion of N-methylol(meth)acrylamide in the copolymer is generally 5–70% by weight, more preferably 10–60% by weight.

The copolymer can be prepared by carrying out polymerization of a mixture of preferably p-styrenesulfonic acid or an alkali metal salt thereof and N-methylol(meth)acrylamide which are preferably dissolved in an alcohol/water mixed solvent, namely, in such a system that they are soluble in the solvent in the form of monomers, but polymer produced with progress of polymerization is insoluble in the solvent and precipitated. A water/alcohol mixed solvent system containing at least 40% by weight of alcohol is especially preferred. The precipitated polymer can be obtained in the form of fine particles if a resin which is soluble in the solvent is previously allowed to be present in carrying out such polymerization. That is, polymerization is carried out under such conditions that the monomers are soluble in the solvent, but the resulting polymer is insoluble in the solvent in the presence of a polymer which acts as a dispersion stabilizer.

Moreover, in the present invention, various monomers can be used as a third component in addition to the styrenesulfonic acid or alkali metal salt thereof and N-methylol(meth)acrylamide. Among them, especially copolymerization of a monomer having an acid group can further improve heat curability of the coat. As such monomers, preferred are acidic monomers such as (meth)acrylic acid, 2-acrylamide-2-methylpropanesulfonic acid and maleic acid. Copolymerization ratio of such acidic monomer is preferably about 0.5–10% by weight.

The polymer for imparting antistatic properties which has heat curability is synthesized in the above manner and a water resistant antistatic film having sufficient performance is formed, but if necessary, monomers such as styrene and derivatives thereof and (meth)acrylate esters may be further copolymerized as other monomers than those mentioned above.

Alkali metal ions such as sodium ion and potassium ion are preferred as a counter ion of styrenesulfonic acid.

Synthesis examples are shown below.

SYNTHESIS EXAMPLE 1

7 g of polyvinylpyrrolidone, 70 g of sodium p-styrenesulfonate and 30 g of N-methylolacrylamide were charged in a 500 ml four-necked flask provided with a stirrer, a thermometer, a nitrogen introduction pipe and a reflux condenser, followed by adding 200 g of ethanol and 100 g of distilled water and dissolving the above compounds in the mixed solvent at 70° C. Then, 1 g of AIBN was added at 75° C. in a nitrogen atmosphere and polymerization was initiated to yield a stable white emulsion.

After elapsing of 3 hours from initiation of the polymerization, ethanol was distilled off under reduced pressure to obtain a homogeneous aqueous polymer solution of low viscosity.

SYNTHESIS EXAMPLE 2

In the same manner as in Synthesis Example 1, 7 g of polyvinylpyrrolidone, 70 g of sodium p-styrenesulfonate, 30 g of N-methylolacrylamide and 5 g of 2 acrylamide-2-methylpropanesulfonic acid were dissolved in a mixed solvent comprising 150 g of ethanol and 150 g of distilled water at 70° C. and polymerization was initiated by adding thereto 1.0 g of AIBN at 75° C. in a nitrogen atmosphere. Immediately after initiation of the polymerization, white polymer fine particles were precipitated to form a milk-white emulsion. After about 1 hour from initiation of the polymerization, 50 g of ethanol was added to the emulsion, followed by further stirring for about 2 hours under heating.

Then, ethanol was distilled off under reduced pressure to obtain a homogeneous aqueous solution.

SYNTHESIS EXAMPLE 3

In the same manner as in Synthesis Example 1, 7 g of polyvinylpyrrolidone, 70 g of sodium p-styrenesulfonate, 25 g of N-methylolacrylamide and 5 g of methacrylic acid were dissolved in 200 g of ethanol and 100 g of distilled water and polymerization was initiated by adding thereto 1.0 g of AIBN at 75° C.

The product was a stable emulsion having a particle size of 1 micron or less.

SYNTHESIS EXAMPLE 4

In the same manner as in Synthesis Example 1, 10 g of polyvinyl alcohol (PVA203 manufactured by Kuraray Co. Ltd.; a partial saponification product of polyvinyl acetate), 70 g of sodium p-styrenesulfonate, 30 g of N-methylolacrylamide and 5 g of 2 acrylamide-2-methylpropanesulfonic acid were dissolved in a mixed solvent comprising 150 g of ethanol and 150 g of distilled water.

Polymerization was initiated by adding thereto 1.0 g of AIBN at 75° C. in a nitrogen atmosphere and furthermore, 50 g of ethanol was added dropwise thereto over a period of 3 hours for stabilization of the resulting emulsion.

Then, ethanol was distilled off under reduced pressure to obtain a homogeneous aqueous solution.

The heat-curable antistatic agent obtained in the present invention alone forms a film on a support such as a film and completely crosslinks in a few hours under a heating condition such as about 50° C.

Coating amount of the electrically conductive polymer of the present invention is usually 0.1–5 g/m$^2$, preferably 0.5–2.0 g/m$^2$ in solid content. If it is less than 0.1 g/m$^2$, antistatic properties are inferior and not practical and if it is more than 5 g/m$^2$, adhesion to the backcoat layer deteriorates.

The electrically conductive polymer layer may contain other binders, if necessary.

The electrically conductive polymer layer must be provided between the backcoat layer containing gelatin and the film base and should not be provided in other positions.

For example, if the antistatic polymer layer is provided not on the film base, but on the backcoat layer provided on the film base, film of the antistatic polymer layer is not sufficiently formed and resistance is high and besides, since the backcoat layer generally contains filter dyes, elimination of the dyes becomes insufficient and this is not preferred. If the antistatic polymer layer is provided between emulsion layer and the film base, this is not preferred since organic solvent is used for application of stripping film for emulsion layer and thus, the emulsion layer side requires higher adhesion than the back side.

Moreover, if the antistatic polymer layer is provided between emulsion layer and protective layer or outside the protective layer, film of the polymer layer is not sufficiently formed and resistance is high. This is also not preferred from the points of progress of development and fixation speed.

Therefore, the antistatic polymer layer should be provided between the film base and the backcoat layer containing gelatin.

There may be considered such construction that the backcoat layer contains no gelatin and thus only a polymer layer is provided or only the electrically conductive polymer layer is provided, but in this case, since the emulsion layer and the protective layer are mainly composed of gelatin, curling of the light-sensitive material occurs much and damages practical value. As aforementioned, in the electrically conductive polymer used in the present invention, proportion of N-methylol(meth)acrylamide is preferably 10–60% by weight. If it is less than 10% by weight, the polymer is not sufficiently crosslinked upon heating and cannot stand alkaline or acidic photographic treatments. If it is more than 60% by weight, proportion of styrenesulfonic acid or alkali metal salt thereof which concerns with antistatic properties correlatively decreases and sufficient antistatic properties cannot be obtained.

Furthermore, pH of coating composition for forming the electrically conductive polymer layer is preferably 1.5–3.0, especially preferably 2.5 or less. If pH is more than 3.0, an electrically conductive layer which can stand photographic treatments cannot be formed and if it is too much acidic, filter dyes in the backcoat layer are adversely affected and absorbance is generally reduced and thus, pH is generally at least 1.5, more preferably at least 2.0.

Any acids may be used for adjusting pH to the above range. Inorganic acids such as phosphoric acid, hydrochloric acid, sulfuric acid and nitric acid are especially preferred, but organic acids such as those having carboxylic acid group or sulfonic acid group may also be used.

Drying temperature at coating of the copolymer comprising N methylol(meth)acrylamide and styrenesulfonic acid is generally 40° C. or higher, preferably 50° C. or higher. If the drying temperature is lower, not only the film which can stand photographic treatments cannot be formed, but also resistance becomes higher after the treatments and this is not preferred. A method in which the light-sensitive material is not sufficiently dried, but taken up in the form of mill roll and heated at high temperatures (at least 40° C.) for many weeks can also be considered. In this case, however, blocking is apt to occur and besides, many weeks are required for heating in the form of mill roll and this is not economical.

In coating of the copolymer comprising N-methylol(meth)acrylamide and styrenesulfonic acid of the present invention, the light-sensitive material is taken up in the form of mill roll and relative humidity in this case is especially important. This relative humidity is preferably 40–60%, especially preferably 45–55%. If this is less than 40%, resistance is high probably because of too high density of the resulting film and besides, adhesion to the backcoat layer is inferior. If it is more than 60%, blocking readily occurs and besides, adhesion to the backcoat layer is inferior.

In the present invention, the electrically conductive polymer layer preferably contains a surface active agent represented by the following formula [I] or [II].

$$R-O(CH_2CH_2O)_nSO_3M \quad (I)$$

(wherein n is a natural number of 1–20, M is H or an alkali metal, and R is an alkyl group of 5–15 carbon atoms or

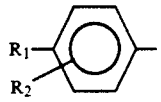

in which $R_1$ is an alkyl group of 5–15 carbon atoms and $R_2$ is an alkyl group of 1–3 carbon atoms, H or a halogen atom).

The surface active agent of the formula [I] is disclosed in U.S Pat. No. 3,026,201, but this patent makes no mention of matching between the copolymer comprising styrenesulfonic acid and N-methylol(meth)acrylamide and the surface active agent.

In the formula [I], n is preferably 20 or less. If it is 21 or more, coatability becomes inferior. It is especially preferably 3–15. The alkyl group of R has 5–15 carbon atoms. If the carbon number is 4 or less, the compound does not acts as a surface active agent to cause deterioration of coatability, resulting in practical problem. If it is 16 or more, oleophilicity is too strong and uneven coating is brought about. The carbon number is especially preferably 8–12. The same as for the alkyl group of R can be applied to $R_1$. M is H or an alkali metal. Especially preferred is sodium ion or potassium ion. $R_2$ is an alkyl group of 1–3 carbon atoms, H or a halogen atom.

Examples of the surface active agents of the formula [I] are shown below.

$$H_{15}C_7-O(CH_2CH_2O)_3SO_3Na \quad \text{I-a}$$

$$H_{27}C_{13}-O(CH_2CH_2O)_4SO_3Na \quad \text{I-b}$$

I-c

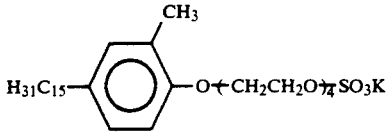

-continued

I-d

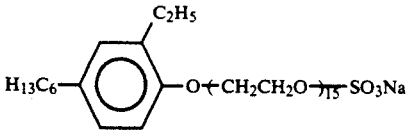

I-e

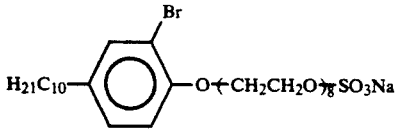

I-f

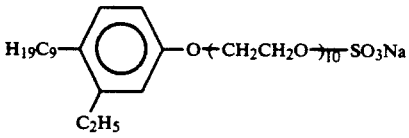

(II)

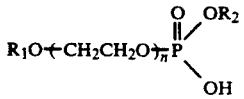

(wherein n is a natural number of 1–20, $R_1$ is an alkyl or aryl group of 5–15 carbon atoms which may be substituted and $R_2$ is an alkyl group of 1–5 carbon atoms which may he substituted.)

The surface active agent of the formula [II] is known, but no mention is made of matching between the copolymer comprising styrenesulfonic acid and N-methylol(meth)acrylamide and the surface active agent.

In the formula [II], n is preferably 20 or less. If it is 21 or more, coatability becomes inferior. It is especially preferably 3–15. The alkyl group of $R_1$ has 5–15 carbon atoms. If the carbon number is 4 or less, the compound does not acts as a surface active agent to cause deterioration of coatability, resulting in practical problem. If it is 16 or more, oleophilicity is too strong and uneven coating is brought about. The carbon number is especially preferably 8–12. $R_2$ is an alkyl group of 1–5 carbon atoms which may be substituted with halogen atom or the like.

Examples of the surface active agents of the formula [II] are shown below.

II-a

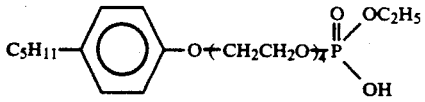

II-b

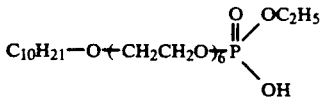

II-c

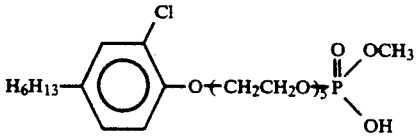

II-d

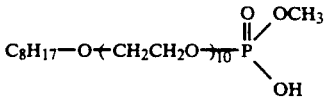

-continued

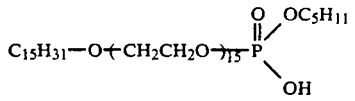

II-e

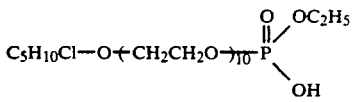

II-f

Addition amount of these surface active agents is preferably 0.05–10 g, especially preferably 0.5–5.0 per 1 liter of coating solution. They may be added at any time.

Furthermore, the electrically conductive layer preferably contains a matting agent. The matting agent is organic or inorganic powder which has an average particle size of preferably 0.2–10μ, especially preferably 0.3–5μ. Examples of the matting agent as organic compounds are water dispersible vinyl polymers such as polymethyl(meth)acrylate, cellulose acetate propionate and starch.

Examples of the matting agent as inorganic compounds are strontium barium sulfate, calcium carbonate, silicon dioxide, magnesium oxide and titanium oxide.

Amount of the matting agent is usually 10 mg–1.0 g, preferably 30 mg–300 mg per 1 liter of coating solution of the electrically conductive polymer.

Amount of gelatin in the backcoat layer is 0.5–8 g/m$^2$, preferably 1–5 g/m$^2$. If necessary, the backcoat layer may further contain the above-mentioned electrically conductive polymers, other electrically conductive polymers, water soluble polymers, hardeners, matting agents, antihalation dyes, surface active agents and the like.

The film base used in the present invention is mainly polyethylene terephthalate film, but other polyester bases may also be used.

On another side of the film base there are provided emulsion layer, protective layer and the like.

EXAMPLE 1

The following solutions were prepared.

| Coating solution for antistatic layer | |
|---|---|
| (I-a) | |
| Distilled water | 500 ml |
| 10 wt % solution of polystyrenesulfonic acid containing 30% by weight of N-methylolacrylamide | 500 ml |
| SNP-4N of Nikko Chemical Co. | 1.0 g |

| Coating solution for backcoat layer | |
|---|---|
| (I-b) | |
| Distilled water | 950 ml |
| Inert gelatin | 50 g |
| Dye (B-1) | 1.0 g |
| Dye (B-2) | 1.0 g |
| Dye (B-3) | 1.0 g |
| 10 wt % solution of AEROL OP of Toho Chemical Co. | 20 ml |
| 10 wt % 2,4 Dichloro-6-hydroxy-S-triazine | 25 ml |

-continued

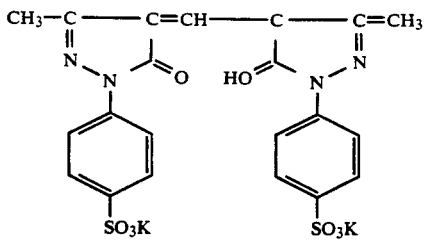

Dye (B-2)

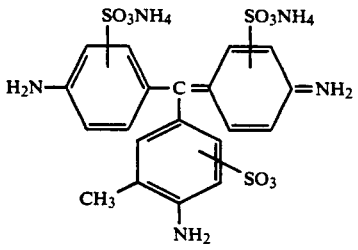

Dye (B-3)

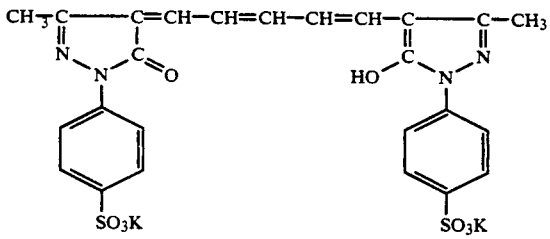

| Coating solution for emulsion | |
|---|---|
| (I-c) | |
| Distilled water | 740 ml |
| Inert gelatin | 30 g |
| AgCl emulsion* (monodispersion of 0.15μ) | 200 g |
| 10 wt % AEROL OP | 20 ml |
| 10 wt % 2,4-Dichloro-6-hydroxy-S-triazine | 10 ml |

| Coating solution for protective layer | |
|---|---|
| (I-d) | |
| Distilled water | 945 ml |
| Inert gelatin | 50 g |
| 10 wt % AEROL OP | 40 ml |
| 10 wt % 2,4-Dichloro-6-hydroxy-S-triazine | 15 ml |

*Monodispersed AgCl emulsion of 0.15μ which was prepared by double jet process. 200 g of this emulsion contained 100 g of silver and 20 g of gelatin.

These coating solutions were coated in an amount of 20 ml/m$^2$ for antistatic layer and 60 ml/m$^2$ for backcoat layer on one side of a polyethylene terephthalate film and 60 ml/m$^2$ for emulsion layer and 20 ml/m$^2$ for protective layer on another side. Each layer was separately coated and was heated at 50° C. for one day for every coating.

The position of the antistatic polymer layer was as follows: (a) between backcoat layer and base; (b) on backcoat layer which was provided on base, namely, as the outermost layer; (c) between emulsion layer and base; (d) between emulsion layer and protective layer; (e) on protective layer, namely, as the outermost layer on another side of base. Furthermore, a sample (f) which did not have the antistatic layer was prepared.

These samples which had been heated were processed by automatic processing machine GR-14 manufactured by Konishiroku Photo Industry Co., Ltd. Development was carried out with MRA CD-101 manufactured by Mitsubishi Paper Mills Ltd. at 35° C. for 20 seconds and fixation was carried out with CF-901 manufactured by Mitsubishi Paper Mills Ltd. at 35° C. for 20 seconds.

Antistatic property was evaluated by measuring surface resistance of samples before and after processing which were left to stand in an atmosphere of 25° C. and 50% RH (relative humidity) for 2 hours by surface resistometer model HT-210 manufactured by Mitsubishi Petrochemical Co., Ltd. When the surface resistance is higher than $10^{12}$ Ω, the antistatic property is bad and when it is $10^{11}$ Ω or lower, the antistatic property is good.

Two kinds of adhesion test were conducted. One is adhesion test on back side of the sample and this was carried out by making scratches at an interval of 5 mm on the surface of the coat by cutter knife, applying water thereto, then strongly rubbing the surface by a tissue paper ten times and observing the rubbed surface. Adhesion of layers on the back side of all samples was good according to this test method.

Another adhesion test was carried out using base cut solution used for application of stripping film.

The base cut solution is to be used only for surface of emulsion layer and so, this test was not carried out for the backcoat side. The base cut solution was one prepared by Dainippon Ink & Chemicals Inc. The surface of emulsion layer was wetted with this solution and was lightly rubbed by tissue paper 3 times. Evaluation was conducted by the following criteria.

x: Peeling occurred over the whole surface.

Δ: Peeling occurred on about half portion.

○: Peeling occurred a little.

With reference to elimination of dye, unexposed portions of ten processed samples were stacked and visually evaluated by the following criteria.

x: Practically inferior.

Δ: Somewhat bad though practically usable.

○: Good

The results are shown in Table 1.

EXAMPLE 2

To 500 ml of distilled water was added 500 ml of a 10 wt % solution of sodium polystyrenesulfonate containing 30% by weight of N-methylolacrylamide and thereto was further added 10 ml of 10 wt % polyethylene oxide anionic surface active agent. Then, pH was varied from 1.3 to 4.0 by adding various acids.

Then, each solution was coated on a subbed polyethylene terephthalate film of 100μ thick at a coating amount of 20 ml/m². The coat was heated at 50° C. for 24 hours and thereon was coated a gelatin layer containing a filter dye as a backcoat layer.

Backcoating solution contained each of the following dyes B-1, B-2 and B-3 in an amount of 50 mg/m².

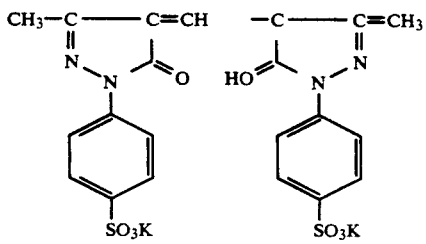

Dye (B-1)

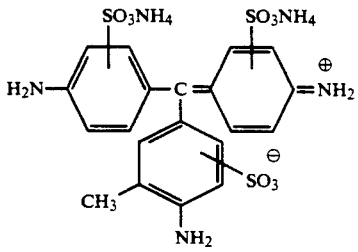

Dye (B-2)

TABLE 1

| Sample No. | Position of antistatic polymer layer | Surface resistance (Ω/cm²) Before processing | After processing | Adhesion (back side) | Adhesion tested by base cut solution | Dye elimination | Note |
|---|---|---|---|---|---|---|---|
| (a) | Between backcoat layer and base | $5 \times 10^9$ | $6 \times 10^{10}$ | ○ | ○ | ○ | The present invention |
| (b) | On backcoat layer, namely, as outermost layer | $7 \times 10^{11}$ | $7 \times 10^{12}$ | ○ | ○ | Δ | Comparative |
| (c) | Between emulision layer and base | $5 \times 10^9$ | $7 \times 10^{10}$ | ○ | x | ○ | " |
| (d) | Between emulsion layer and protective layer | $3 \times 10^{12}$ | $6 \times 10^{12}$ | ○ | ○ | ○ | " |
| (e) | On protective layer, namely, outermost layer | $3 \times 10^{11}$ | $4 \times 10^{12}$ | ○ | ○ | ○ | " |
| (f) | — | $3 \times 10^{13}$ | $5 \times 10^{13}$ | ○ | ○ | ○ | " |

As can be seen from Table 1, when copolymer of N-methylol(meth)acrylamide and styrenesulfonic acid is used as antistatic layer, it is most preferred to provide this polymer between backcoat layer and base.

-continued

Dye (B-3)

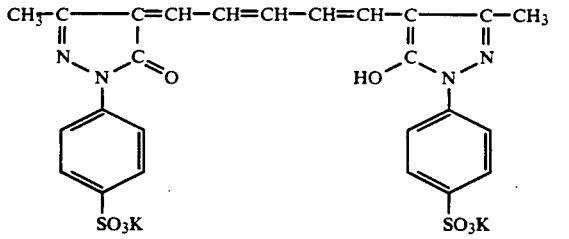

Inert gelatin was used as gelatin and was coated on electrically conductive antistatic polymer layer at a coating amount of 3.0 g/m$^2$. As a surface active agent, a 10 wt % solution of AEROL OP of Toho Chemical Co. was added in an amount of 2% based on volume of backcoating solution and as a hardener, 10 wt % 2,4-dichloro-6-hydroxy-S-triazine was added in an amount of 0.5 ml based on 1 g of gelatin.

These samples were subjected to development and fixation in the same manner as in Example 1.

Antistatic property was measured and evaluated in the same manner as in Example 1.

Adhesion property was evaluated as follows. Surface of the sample was cut crosswise by a knife to form squares having a side of 5 mm, and the sample was dipped in water of 30° C. for 30 seconds and then the surface was rubbed by a tissue paper. The results were evaluated by the following criteria.

○: No peeling occurred.

Δ: Peeling slightly occurred.

x: Peeling somewhat occurred.

Discoloration of the filter dye was evaluated by comparing with a sample in which the backcoat layer was coated on the base without the polymer layer as standard.

x: Discoloration somewhat occurred.

Δ: Discoloration slightly occurred.

○: No discoloration occurred.

The results are shown in Table 2.

TABLE 2

| Acid | pH | Surface resistance (Ω/cm$^2$) Before processing | After processing | Adhesion | Discloration |
|---|---|---|---|---|---|
| Sulfuric acid | 1.3 | $9 \times 10^8$ | $8 \times 10^9$ | ○ | x |
| | 1.5 | $3 \times 10^9$ | $1 \times 10^{10}$ | ○ | Δ |
| | 2.0 | $3 \times 10^9$ | $2 \times 10^{10}$ | ○ | Δ |
| | 2.5 | $5 \times 10^9$ | $2 \times 10^{10}$ | ○ | ○ |
| | 3.0 | $7 \times 10^9$ | $1 \times 10^{10}$ | Δ | ○ |
| | 3.2 | $4 \times 10^{10}$ | $8 \times 10^{10}$ | x | ○ |
| | 3.5 | $4 \times 10^{10}$ | $1 \times 10^{12}$ | x | ○ |
| | 4.0 | $8 \times 10^{10}$ | $3 \times 10^{12}$ | x | ○ |
| Phosphoric acid | 1.3 | $2 \times 10^9$ | $1 \times 10^{10}$ | x | x |
| | 1.5 | $2 \times 10^9$ | $2 \times 10^{10}$ | ○ | Δ |
| | 2.0 | $5 \times 10^9$ | $1 \times 10^{10}$ | ○ | Δ |
| | 2.5 | $6 \times 10^9$ | $3 \times 10^{10}$ | ○ | ○ |
| | 3.0 | $6 \times 10^9$ | $3 \times 10^{10}$ | ○ | ○ |
| | 3.2 | $7 \times 10^{10}$ | $3 \times 10^{12}$ | x | ○ |
| | 3.5 | $8 \times 10^{10}$ | $1 \times 10^{12}$ | x | ○ |
| | 4.0 | $6 \times 10^{10}$ | $5 \times 10^{12}$ | x | ○ |
| Hydrochloric acid | 1.3 | $1 \times 10^9$ | $1 \times 10^{10}$ | ○ | x |
| | 1.5 | $3 \times 10^9$ | $2 \times 10^{10}$ | ○ | Δ |
| | 2.0 | $2 \times 10^9$ | $2 \times 10^{10}$ | ○ | Δ |
| | 2.5 | $5 \times 10^9$ | $1 \times 10^{10}$ | ○ | ○ |
| | 3.0 | $4 \times 10^9$ | $2 \times 10^{10}$ | Δ | ○ |
| | 3.2 | $6 \times 10^{10}$ | $9 \times 10^{10}$ | x | ○ |
| | 3.5 | $9 \times 10^{10}$ | $3 \times 10^{12}$ | x | ○ |

TABLE 2-continued

| Acid | pH | Surface resistance (Ω/cm$^2$) Before processing | After processing | Adhesion | Discloration |
|---|---|---|---|---|---|
| | 4.0 | $8 \times 10^{10}$ | $4 \times 10^{12}$ | x | ○ |

As can be seen from Table 2, if pH of coating solution for polymer layer is less than 1.5, the dyes discolor and this is not preferred and if it is more than 3.0, resistance after processing increases and besides, adhesion deteriorates. Therefore, when a polymer of N-methylol(meth-)acrylamide and styrenesulfonic acid is used as an antistatic layer and a gelatin layer is coated on the antistatic polymer layer, pH of the polymer layer is preferably 1.5–3.0.

EXAMPLE 3

To 500 ml of distilled water was added 500 ml of a 10 wt % solution of sodium polystyrenesulfonate containing 30% by weight of N-methylolacrylamide and thereto was further added 10 ml of 10 wt % solution of the surface active agent I-a exemplified above.

The above coating solution was coated on a subbed polyethylene terephthalate film of 100μ thick with changing the maximum temperature of drying zone of coater at every 10° C. from 20° C. to 70° C. Coating amount was 20 ml/m$^2$ and coating speed was 20 m/min. Atmosphere of the portion from completion of drying until winder was of 25° C. and 50% in relative humidity.

The sample wound by winder was put in a moisture-proof bag as it was and left to stand for 3 days at room temperature.

Thereafter, a gelatin solution was coated as a backcoat on the above coated electrically conductive polymer layer. The gelatin solution was a solution of 50 g of inert gelatin in 950 ml of distilled water, to which was added 20 ml of 10 wt % solution of compound 1-a as surface active agent. As a hardener, 25 ml of 10 wt % 2,4-dichloro-6-hydroxy-S-triazine was further added and this gelatin solution was coated at a coating amount of 50 ml/m$^2$. Drying temperature in this case was 45° C.

The resulting samples were heated at 50° C. for 1 day and were processed in the same manner as in Example 1.

The samples were subjected to evaluation of antistatic property and adhesion property in the same manner as in Example 2. The results are shown in Table 3.

TABLE 3

| No. | Maximum drying temperature | Surface resistance (Ω/cm$^2$) Before processing | After processing | Adhesion | Others |
|---|---|---|---|---|---|
| 1 | 20° C. | $8 \times 10^9$ | $4 \times 10^{12}$ | x | Partial blocking occurred |
| 2 | 30° C. | $7 \times 10^9$ | $5 \times 10^{12}$ | x | |
| 3 | 40° C. | $5 \times 10^9$ | $2 \times 10^{11}$ | Δ | |
| 4 | 50° C. | $6 \times 10^9$ | $3 \times 10^{10}$ | ○ | |
| 5 | 60° C. | $5 \times 10^9$ | $2 \times 10^{10}$ | ○ | |
| 6 | 70° C. | $5 \times 10^9$ | $4 \times 10^{10}$ | ○ | |
| 7 | 75° C. | $6 \times 10^9$ | $3 \times 10^{10}$ | ○ | |

As can be seen from Table 3, when the drying temperature is lower than 30° C., adhesion and resistance after processing are not satisfactory. It seems that even if a drying temperature of 20°–30° C. is employed, satisfactory result will be obtained if drying is carried out for a long time, but the data shows substantially no change even if coating speed is 10 m/min. Thus, it appears that water retention characteristics of the polymer are concerned therewith.

EXAMPLE 4

Example 3 was repeated except that the maximum temperature of the drying zone of coater was 50° C., temperature of atmosphere from completion of drying until winder part was 25° C. and relative humidity thereof was changed from 30–70% at every 10%.

The results are shown in Table 4.

TABLE 4

| No. | Relative humidity of winding-up part | Surface resistance (Ω/cm²) Before processing | After processing | Adhesion | Others |
|---|---|---|---|---|---|
| 1 | 30% | $5 \times 10^{11}$ | $2 \times 10^{12}$ | x | |
| 2 | 40% | $7 \times 10^{9}$ | $1 \times 10^{11}$ | ○ | |
| 3 | 50% | $6 \times 10^{9}$ | $3 \times 10^{10}$ | ○ | |
| 4 | 60% | $5 \times 10^{9}$ | $3 \times 10^{10}$ | Δ | |
| 5 | 70% | $4 \times 10^{9}$ | $4 \times 10^{10}$ | x | Partial blocking occurred |

As can be seen from Table 4, when relative humidity of the above atmosphere is 30%, the sample is inferior in adhesion and low in resistance. In the case of 70%, the sample is inferior in adhesion and shows partial blocking. Therefore, when a polymer of N-methylol(meth)acrylamide and styrenesulfonic acid is used as antistatic layer, it is important that drying temperature is 40° C. or higher and humidity at winding is 40–60%.

EXAMPLE 5

To 500 ml of distilled water was added 500 ml of a 10 wt % solution of sodium polystyrenesulfonate containing 30% by weight of N-methylolacrylamide and thereto was further added 10 ml of 10 wt % solution of the surface active agent shown in the following Table 5.

TABLE 5

| No. | Name | Maker | Type |
|---|---|---|---|
| A-a | AEROL OP | Toho Chemical Co. | Anionic |
| A-b | ACTINOL K | Matsumoto Yushi Co. | Nonionic |
| A-c | ZONTES TL | Matsumoto Yushi Co. | Cationic |
| A-d | SUNSTAT 1007 | Sanyo Kasei Co. | Amphoteric |
| A-e | I-a | — | Polyethylene Oxide.anion |
| A-f | II-a | — | Polyethylene Oxide.anion |

Then, each solution was coated on a subbed polyethylene terephthalate film of 100μ thick at a coating amount of 20 ml/m² and thereafter, heated at 50° C. for 24 hours and a gelatin solution was coated thereon as a backcoat layer.

The gelatin solution was a solution of 50 g of inert gelatin in 950 ml of distilled water, to which was added 20 ml of 10 wt % solution of AEROL OP as a surface active agent. As a hardener, 20 ml of 10 wt % 2,4-dichloro-6-hydroxy-S triazine was further added and this gelatin solution was coated on the above coated polymer layer at a coating amount of 50 ml/m².

These samples were heated at 50° C. for 1 day and processed in the same manner as in Example 1.

Evaluation of antistatic property and adhesion property were conducted in the same manner as in Example 2.

The results are shown in Table 6.

TABLE 6

| Sample No. | Surface resistance (Ω/cm²) Before processing | After processing | Adhesion | Others |
|---|---|---|---|---|
| A-a | $3 \times 10^{9}$ | $2 \times 10^{10}$ | ○ | Uneven coating. Polymer layer was hazed. |
| A-b | $3 \times 10^{11}$ | Over range* | Δ | Good coating |
| A-c | $4 \times 10^{10}$ | Over range* | Δ | Some uneven coating occured. |
| A-d | $4 \times 10^{9}$ | $6 \times 10^{11}$ | Δ | Good coating. Polymer layer was hazed. |
| A-e | $6 \times 10^{9}$ | $3 \times 10^{10}$ | ○ | Good coating |
| A-f | $7 \times 10^{9}$ | $5 \times 10^{10}$ | ○ | Good coating |

*"Over range" means the surface resistance of more than $10^{13}$ Ω/cm².

As can be seen from Table 6, when AEROL OP was used, coatability was inferior and the polymer layer was hazed. This material was not accepted, when ACTINOL K was used, coatability was good, but adhesion was somewhat inferior and resistance after processing was high. When ZONTES TL was used, some uneven coating occurred and resistance after processing was high. When SUNSTAT 1007 was used, coatability was good, but adhesion was somewhat bad and the polymer layer was hazed and resistance after processing was high. From these results, it can be seen that the compounds I-a and II-a of the present invention are superior in coatability, resistance and adhesion.

EXAMPLE 6

Example 5 was repeated except that content of N-methylolacrylamide was variously changed and compound I-c exemplified above was used.

The results are shown in Table 7.

TABLE 7

| No. | Content of N-methylol-acrylamide (% by weight) | Surface resistance (Ω/cm²) Before processing | After processing | Adhesion | Others |
|---|---|---|---|---|---|
| 1 | 5 | $7 \times 10^{8}$ | — | x peeled after processing. | Film |
| 2 | 10 | $3 \times 10^{9}$ | $1 \times 10^{11}$ | Δ | |
| 3 | 20 | $4 \times 10^{9}$ | $5 \times 10^{10}$ | ○ | |
| 4 | 30 | $6 \times 10^{9}$ | $3 \times 10^{10}$ | ○ | |
| 5 | 40 | $8 \times 10^{9}$ | $4 \times 10^{10}$ | ○ | |
| 6 | 50 | $1 \times 10^{10}$ | $5 \times 10^{10}$ | ○ | |
| 7 | 60 | $5 \times 10^{10}$ | $6 \times 10^{11}$ | ○ | |
| 8 | 70 | $5 \times 10^{11}$ | $8 \times 10^{12}$ | ○ | |
| 9 | 80 | $7 \times 10^{11}$ | Over range | ○ | |
| 10 | 90 | — | — | — | Polymer could not be synthesized. |
| 11 | 95 | — | — | — | Polymer could not be synthesized. |

As can be seen from Table 7, when content of N-methylolacrylamide was less than 5% by weight, cross-linking of the polymer was insufficient and the coat somewhat peeled off in the automatic processing machine. When content of N-methylolacrylmide was more than 90% by weight, synthesis of the polymer was difficult. When it was 70–80% by weight, resistance after processing was high and this was not preferred. Therefore, content of N-methylol(meth)acrylamide is preferably 10–60% by weight.

EXAMPLE 7

Example 6 was repeated except that compound II-e was used in place of compound I-c as a surface active agent.

The results are shown in Table 8.

TABLE 8

| No. | Content of N-methylol-acrylamide (% by weight) | Surface resistance ($\Omega/cm^2$) Before processing | After processing | Adhesion | Others |
|---|---|---|---|---|---|
| 1 | 5 | $8 \times 10^8$ | — | x | Film peeled after processing. |
| 2 | 10 | $5 \times 10^9$ | $2 \times 10^{11}$ | Δ | |
| 3 | 20 | $4 \times 10^9$ | $6 \times 10^{10}$ | ○ | |
| 4 | 30 | $7 \times 10^9$ | $5 \times 10^{10}$ | ○ | |
| 5 | 40 | $6 \times 10^9$ | $4 \times 10^{10}$ | ○ | |
| 6 | 50 | $2 \times 10^{10}$ | $6 \times 10^{10}$ | ○ | |
| 7 | 60 | $4 \times 10^{10}$ | $6 \times 10^{11}$ | ○ | |
| 8 | 70 | $6 \times 10^{11}$ | $8 \times 10^{12}$ | ○ | |
| 9 | 80 | $8 \times 10^{11}$ | Over range | ○ | |
| 10 | 90 | — | — | — | Polymer could not be synthesized. |
| 11 | 95 | — | — | — | Polymer could not be synthesized. |

As can be seen from Table 8, when content of N-methylolacrylmide was less than 5% by weight, cross-linking of the polymer was insufficient and the coat somewhat peeled off in the automatic processing machine. When content of N-methylolacrylmide was more than 90% by weight, synthesis of the polymer was difficult. When it was 70–80% by weight, resistance after processing was high and this was not preferred. Therefore, content of N-methylol(meth)acrylamide is preferably 10–60% by weight.

EXAMPLE 8

To 500 ml of distilled water was added 500 ml of a 10 wt % solution of sodium polystyrenesulfonate containing 30% by weight of N-methylolacrylamide and thereto was added 10 wt % solution of compound I-a as a surface active agent and thereto was further added a matting agent (SY-244 manufactured by Fuji Davidson Co.) with changing the addition amount thereof.

Each solution obtained above was coated on a subbed polyethylene terephthalate film of 100μ thick at a coating amount of 20 ml/m² and then dried. The sample after dried was cut to A4 size and ten of these samples of A4 size were stacked and sandwiched between two plates and left to stand at 50° C. for 24 hours under application of strong pressure.

Thereafter the stacked samples were peeled off from each other and state of blocking was observed and evaluated by the following criteria.

x: Blocking occurred over the whole surface.

Δ: Blocking partially occurred.

○: No blocking occurred.

The results are shown in Table 9.

TABLE 9

| No. | Amount of SY-244 per 1 l of coating solution | Blocking | State of coat |
|---|---|---|---|
| 1 | 0 | x | Transparent |
| 2 | 10 mg | Δ | " |
| 3 | 30 mg | ○ | " |
| 4 | 100 mg | ○ | " |
| 5 | 300 mg | ○ | Somewhat hazed |
| 6 | 1.0 g | ○ | Hazed |
| 7 | 3.0 g | ○ | " |

As can be seen from Table 9, blocking occurred in the samples containing no matting agent.

Next, a gelatin solution was coated as a backcoat layer on the polymer layer of the above samples 2–7.

The gelatin solution was a solution of 50 g of inert gelatin in 950 ml of distilled water, to which was added 20 ml of 10 wt % solution of AEROL OP as a surface active agent. As a hardener, 20 ml of 10 wt % 2,4-dichloro-6-hydroxy-S-triazine was further added and this gelatin solution was coated on the above coated polymer layer at a coating amount of 50 ml/m².

These samples were heated at 50° C. for 1 day and processed in the same manner as in Example 1.

Evaluation of antistatic property and adhesion property were conducted in the same manner as in Example 2.

TABLE 10

| Amount of SY244 per 1 l of coating solution | Surface resistance ($\Omega/cm^2$) Before processing | After processing | Adhesion | State of coat |
|---|---|---|---|---|
| 10 mg | $5 \times 10^9$ | $3 \times 10^{10}$ | ○ | Transparent |
| 30 mg | $4 \times 10^9$ | $2 \times 10^{10}$ | ○ | " |
| 100 mg | $5 \times 10^9$ | $3 \times 10^{10}$ | ○ | " |
| 300 mg | $6 \times 10^9$ | $2 \times 10^{10}$ | ○ | " |
| 1.0 g | $2 \times 10^{10}$ | $3 \times 10^{11}$ | Δ | Somewhat hazed |
| 3.0 g | $3 \times 10^{11}$ | $3 \times 10^{12}$ | x | Hazed |

As can be seen from Table 10, when too much amount of matting agent was contained, resistance increased and adhesion became inferior and besides, the coat was hazed. Therefore, amount of the matting agent is preferably 10 mg/m² to 1.0 g/m². This amount is similar for any matting agents.

In the above Examples 2, 3, 5 and 8, a protective layer and an emulsion layer were coated on another side of the film base in the same manner as in Example 1.

What is claim is:

1. A silver halide light-sensitive film material which has an electrically conductive polymer layer between a film base and a backcoat layer wherein the electrically conductive polymer is a copolymer of N-methylol(meth)acrylamide and styrenesulfonic acid.

2. A silver halide light-sensitive material according to claim 1, wherein the copolymer comprises 10–60% by weight of N-methylol(meth)acrylamide.

3. A silver halide light-sensitive material according to claim 1 or 2, wherein a coating solution for the polymer layer has a pH of 1.5–3.0.

4. A silver halide light-sensitive material according to claim 1 or 2, wherein the polymer layer as coated is dried at a temperature of 40° C. or higher and the material after completion of drying is wound up in an atmosphere of 40–60% in relative humidity.

5. A silver halide light-sensitive material according to claim 1 or 2, wherein the polymer layer contains a surface active agent represented by the following formula [I] or [II]:

$$R-O\leftarrow CH_2CH_2O\rightarrow_n SO_3M \quad (I)$$

wherein n is a natural number of 1–20, M is H or an alkali metal, and R is an alkyl group of 5–15 carbon atoms or

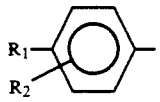

in which $R_1$ is an alkyl group of 5–15 carbon atoms and $R_2$ is an alkyl group of 1–3 carbon atoms, H or a halogen atom, $$R_1O\leftarrow CH_2CH_2O\rightarrow_n P(=O)(OR_2)(OH) \quad (II)$$

wherein n is a natural number of 1–20, $R_1$ is an alkyl or aryl group of 5–15 carbon atoms which may be substituted and $R_2$ is an alkyl group of 1–5 carbon atoms which may be substituted.

6. A silver halide light-sensitive film material according to claim 1 or 2, wherein the electrically conductive polymer layer contains a matting agent.

7. A silver halide light-sensitive film material according to claim 1, wherein amount of the electrically conductive polymer is 0.1–5 g/m$^2$ in solid content.

8. A silver halide light-sensitive film material according to claim 1, wherein amount of gelatin in the backcoat layer is 0.5–8 g/m$^2$.

9. A silver halide light-sensitive film material according to claim 5, wherein amount of the surface active agent is 0.05–10 g for 1 liter of coating solution.

10. A silver halide light-sensitive film material according to claim 6, wherein the matting agent is an inorganic or organic powder having an average particle size of 0.2–10μ.

11. A silver halide light-sensitive film material according to claim 6, wherein amount of the matting agent is 10 mg–1.0 g for 1 liter of coating solution.

12. A silver halide light-sensitive film material according to claim 1, wherein at least one photographic layer including a silver halide emulsion layer is provided on another side of the base film.

* * * * *